US008794016B2

(12) United States Patent
Ogden et al.

(10) Patent No.: US 8,794,016 B2
(45) Date of Patent: Aug. 5, 2014

(54) MONITORING THE HEALTH OF A CRYOCOOLER

(75) Inventors: Robert R. Ogden, McKinney, TX (US); Paul H. Barton, Grand Prairie, TX (US); Bernard D. Heer, McKinney, TX (US); Bradley A. Ross, Los Olivos, CA (US); Carl S. Kirkconnell, Huntington Beach, CA (US); Raymond R. Beshears, Van Alstyne, TX (US)

(73) Assignee: Raytheon Company, Waltham, MA (US)

( * ) Notice: Subject to any disclaimer, the term of this patent is extended or adjusted under 35 U.S.C. 154(b) by 1149 days.

(21) Appl. No.: 12/540,576

(22) Filed: Aug. 13, 2009

(65) Prior Publication Data

US 2010/0037639 A1 Feb. 18, 2010

Related U.S. Application Data

(60) Provisional application No. 61/088,819, filed on Aug. 14, 2008.

(51) Int. Cl.
*F25B 9/00* (2006.01)

(52) U.S. Cl.
CPC ..... *F25B 9/00* (2013.01)
USPC ..... 62/127

(58) Field of Classification Search
CPC ..... F25B 9/00; F25B 49/00; F25B 49/005
USPC ..... 62/6, 125–127, 129, 600; 374/5
See application file for complete search history.

(56) References Cited

U.S. PATENT DOCUMENTS

| | | | | |
|---|---|---|---|---|
| 5,566,092 | A * | 10/1996 | Wang et al. | 702/185 |
| 6,256,999 | B1 * | 7/2001 | Chase | 62/6 |
| 6,516,282 | B2 * | 2/2003 | Hedlund et al. | 702/132 |
| 6,684,349 | B2 * | 1/2004 | Gullo et al. | 714/47.2 |
| 6,774,632 | B2 * | 8/2004 | Kono | 324/318 |
| 7,024,867 | B2 | 4/2006 | Arman et al. | 62/6 |
| 7,209,778 | B2 * | 4/2007 | Dean et al. | 600/412 |
| 7,249,465 | B2 | 7/2007 | Arman et al. | 62/6 |
| 7,266,947 | B2 * | 9/2007 | Keiter et al. | 62/6 |
| 2001/0055102 | A1 * | 12/2001 | Emoto | 355/53 |
| 2005/0210889 | A1 * | 9/2005 | Arman et al. | 62/6 |
| 2006/0225433 | A1 * | 10/2006 | Jammu et al. | 62/6 |

OTHER PUBLICATIONS

Sandt et al., Cryocooler Prognostic Health Management System, May 17, 2008, Smartech, Conf. Proc. pp. 6555-6665; and AIP, Conf. Proc. 985, pp. 427-434.*

Shah et al. "Cryocooler Prognastic Health Management System", Advances in Cryogenic Engineering: Transactions of the Cryogenic Engineering Conference—CEC, vol. 53, American Institutes of PHysics Conference Proceedings, vol. 985, pp. 427-434; Feb. 2008.*

(Continued)

*Primary Examiner* — Frantz Jules
*Assistant Examiner* — Emmanuel Duke

(57) ABSTRACT

According to certain embodiments, monitoring the health of a cryocooler includes monitoring physical properties of the cryocooler to obtain failure precursor parameters that indicate cryocooler health. A health fingerprint of the cryocooler is accessed. The health fingerprint associates the failure precursor parameters with a health level of the cryocooler. The health of the cryocooler is estimated in accordance with the health level.

28 Claims, 4 Drawing Sheets

(56) References Cited

OTHER PUBLICATIONS

Sandt et al. "Cryocooler Prognastic Health Management System" at the international Cryocooler conference, May 2008, Atlanta, Georgia.*

PCT, Notification of Transmittal of the International Search Report and the Written Opinion of the International Searching Authority, or the Declaration, International Application No. PCT/US2009/053805, 16 pages, Feb. 19, 2010.

Shah, A., et al., "*Cryocooler Prognostic Health Management System*", Advances in Cryogenic Engineering: Transactions of the Cryogenic Engineering Conference—CEC, vol. 52, American Institute of Physics Conference Proceedings, vol. 985, pp. 427-434, Mar. 16, 2008.

Invitation to Pay Additional Fees and, Where Applicable, Protest Fee, PCT/US2009/053805, 6 pages, dated Nov. 4, 2009.

* cited by examiner

MONITORING THE HEALTH OF A CRYOCOOLER

RELATED APPLICATIONS

This application claims priority to U.S. Provisional Patent Application Ser. No. 61/088,819, entitled "MONITORING THE HEALTH OF A CRYOCOOLER," which was filed on Aug. 14, 2008. U.S. Provisional Patent Application Ser. No. 61/088,819 is hereby incorporated by reference.

TECHNICAL FIELD

This invention relates generally to the field of system monitors and more specifically to monitoring the health of a cryocooler.

BACKGROUND

Cryocoolers are thermal management devices designed to provide cooling at temperatures of, for example, −153° C. or lower. Cryocoolers may be used in, for example, infrared detectors. Cryocoolers may have limited lifetimes, such as 3,000 to 10,000 operating hours. Cryocoolers will eventually fail to operate and may need to be repaired or replaced.

SUMMARY OF THE DISCLOSURE

In accordance with the present invention, disadvantages and problems associated with previous techniques for monitoring cryocooler health (for example, degradation) may be reduced or eliminated.

According to certain embodiments, monitoring the health of a cryocooler includes monitoring physical properties of the cryocooler to obtain failure precursor parameters that indicate cryocooler health. A health fingerprint of the cryocooler is accessed. The health fingerprint associates the failure precursor parameters with a health level of the cryocooler. The health of the cryocooler is estimated in accordance with the health level.

Certain embodiments of the invention may provide one or more technical advantages. A technical advantage of one embodiment may be that a cryocooler health monitoring system can detect and estimate cryocooler health. The system may provide a notification of a cryocooler that exhibits poor health or impending failure to allow for removal and/or repair of the cryocooler. The system may reduce the probability of cryocooler failure during missions, which may increase mission reliability and reduce costs.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1 through 6 of the drawings, like numerals being used for like and corresponding parts of the various drawings.

Figure 1:
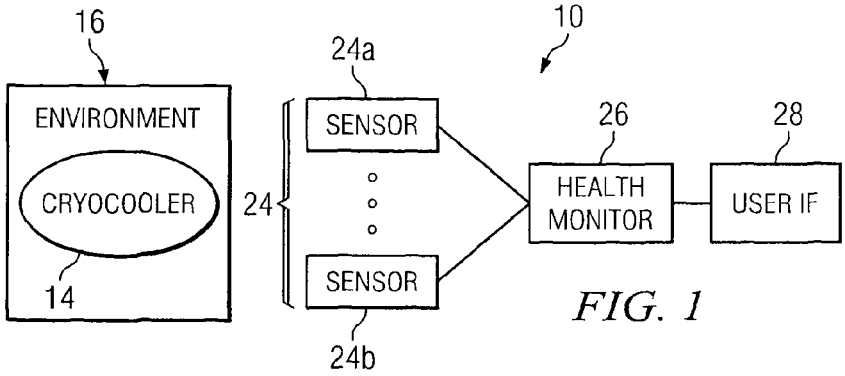
FIG. 1 illustrates an example of a cryocooler health monitoring system.

FIG. 1 illustrates an example of a cryocooler health monitoring system 10 that monitors a cryocooler 14 in an environment 16 to detect and estimate cryocooler health. System 10 may provide a notification of a cryocooler that exhibits poor health to allow for removal and/or repair of the cryocooler. System 10 may reduce the probability of cryocooler failure during missions, which may increase mission reliability and reduce costs.

Cryocooler 14 may be any suitable thermal management device that provides cooling at low temperatures, for example, at temperatures of −150° C. or lower. Cryocoolers 14 may include Dewar assemblies (such as standard Dewar assemblies or standard advanced Dewar assemblies). The majority of cryocoolers for military applications may be referred to as "tactical cryocoolers."

Cryocooler 14 may be used in any suitable system, for example, a sensor system such as an infrared or near infrared sensor system. For example, a cryocooler 14 may be used to provide cooling for the focal plane detector arrays of the sensor system. The sensor systems may be used in turn in other systems, for example, target acquisition systems.

In certain embodiments, the health level of cryocooler 14 describes the health of cryocooler 14. For example, the health level may indicate whether cryocooler 14 is operating properly. A system may be operating properly if, given appropriate input, the system provides appropriate output. Accordingly, cryocooler 14 may be operating properly, if given appropriate operating conditions, cryocooler 14 provides appropriate cooling. As another example, the health level may indicate the remaining useful life of cryocooler 14. Remaining useful life may indicate the remaining amount of time that cryocooler 14 may be operating properly.

In certain embodiments, system 10 includes one or more measurement sensors 24 (24*a-b*), a health monitor 26, and a user interface (IF) 28. In certain embodiments, sensors 24 may monitor physical properties of cryocooler 14 to obtain one or more failure precursor parameters that indicate the health of cryocooler 14. A physical property of cryocooler 14 may be a physical property that cryocooler 14 itself exhibits, such as the skin temperature, exported vibration, and/or sounds exhibited by cryocooler 14. A physical property of cryocooler 14 may also be a physical property of an input to or output from cryocooler 14, such as the waveform of input or output current or voltage.

The parameters may describe the physical properties of cryocooler 14, environment 16 of cryocooler 14, and/or the operation of cryocooler 14. Parameters may describe physical properties in any suitable manner. For example, parameters may describe values taken from measurements of the physical properties. These parameters may include the actual measured values or values derived from the measured values (such as values converted to a different unit).

As another example, parameters may describe statistics of the measurement values. These parameters may include the average, standard deviation, rate of change of the values, and extrapolations or interpolations of the values. The statistics may describe values taken over time or across different cryocooler components. As another example, parameters may describe the results of applying a function to the measurement values. These parameters may include the results of a function that compares values taken from measurements at different times and/or of different components.

System 10 may include one or more sensors 24, such as one or more of any, some, or all of the following: acoustic sensors, vibration sensors, thermal sensors, and/or input current and/or voltage waveform monitors. One or more sensors 24 may be implemented as embedded built-in-test sensors attached internally to cryocooler 14 or as stand alone sensors that can be externally attached to cryocooler 14. Sensors 24 are described in more detail with reference to FIG. 2.

In certain embodiments, health monitor 26 accesses a health fingerprint that associates the failure precursor parameters with the health level cryocooler 14. Health monitor 26 estimates the health of cryocooler 14 in accordance with the health level and provides a result to user interface 28. Health monitor 26 is described in more detail with reference to FIG. 2.

User interface 28 may be any suitable computer system through which health monitor 26 may provide estimates of the cryocooler health to, for example, a user or another system. The cryocooler health may be provided in response to a request or a failure event or according to a schedule of reporting times. The cryocooler health may be provided in the form of a notification.

A component of system 10 and other the systems and apparatuses disclosed herein may include an interface, logic, memory, and/or other suitable element. An interface receives input, sends output, processes the input and/or output, and/or performs other suitable operation. An interface may comprise hardware and/or software.

Logic performs the operations of the component, for example, executes instructions to generate output from input. Logic may include hardware, software, firmware, and/or other logic. Logic may be encoded in one or more tangible media and may perform operations when executed by a computer. Certain logic, such as a processor, may manage the operation of a component. Examples of a processor include one or more computers, one or more microprocessors, one or more applications, and/or other logic.

In particular embodiments, the operations of the embodiments may be performed by one or more computer readable media encoded with a computer program, software, computer executable instructions, and/or instructions capable of being executed by a computer. In particular embodiments, the operations of the embodiments may be performed by one or more computer readable media storing, embodied with, and/or encoded with a computer program and/or having a stored and/or an encoded computer program.

A memory stores information. A memory may comprise one or more tangible, computer-readable, and/or computer-executable storage medium. Examples of memory include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Figure 2:
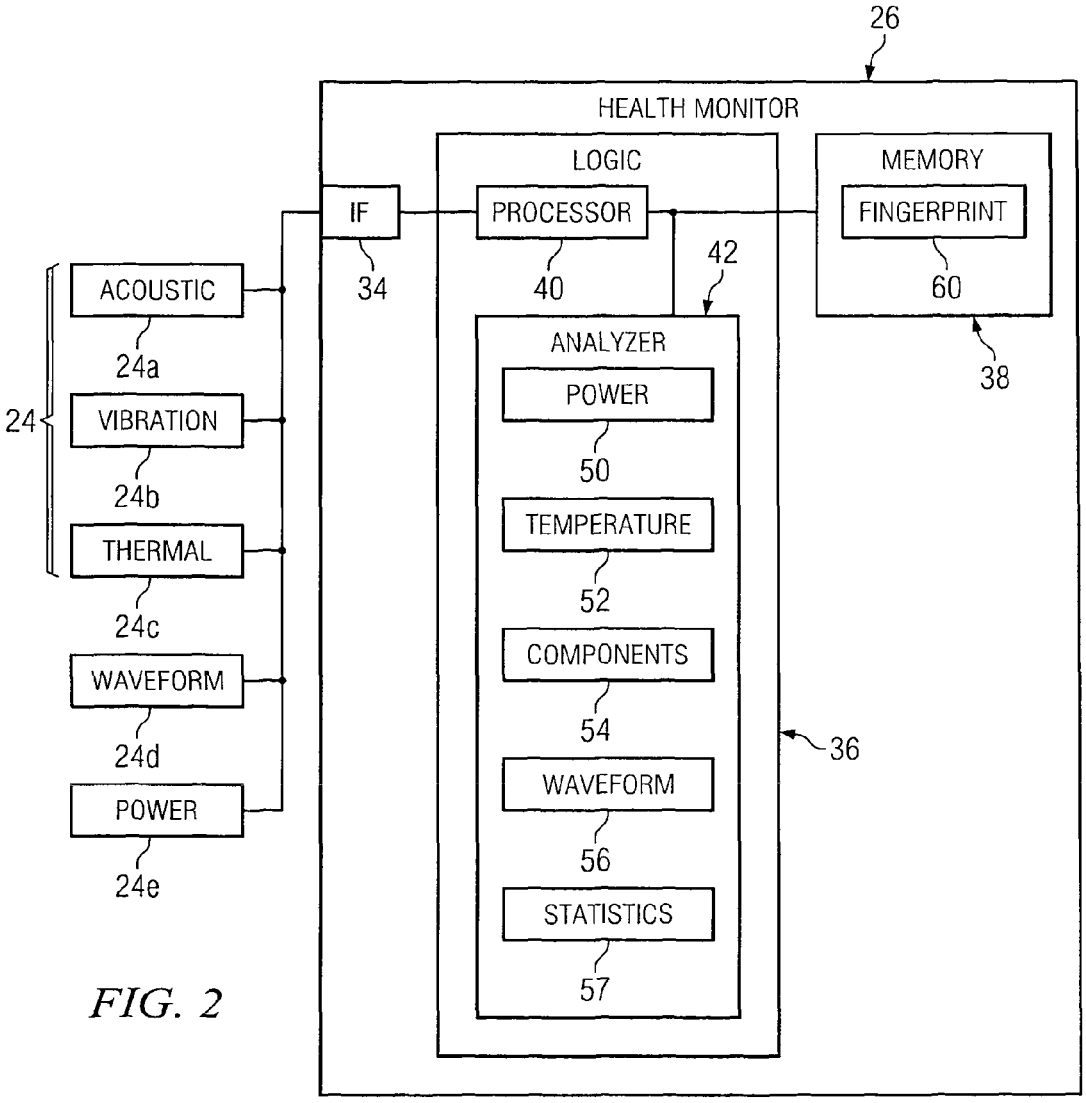
FIG. 2 illustrates examples of sensors and a health monitor that may be used with the system of FIG. 1.

FIG. 2 illustrates examples of sensors 24 and health monitor 26 that may be used with system 10 of FIG. 1. In the example, sensors 24 include one or more acoustic sensors 24*a*, one or more vibration sensor 24*b*, one or more thermal sensors 24*c*, one or more input current and/or voltage waveform monitors 24*d*, and/or one or more power monitors 24*e*. In the example, health monitor 26 includes an interface 34, logic 36, and a memory 38. Logic 36 includes a processor 40 and an analyzer 42. Analyzer 42 includes modules such as a power module 50, a temperature module 52, a components module 54, a waveform module 56, and a statistics module 57. Memory 38 stores a health fingerprint 60.

Health fingerprint 60 associates failure precursor parameters with a health level of cryocooler 14. In certain embodiments, health fingerprint 60 may associate certain parameters with a health level that indicates that cryocooler 14 is operating properly. As an example, for certain cryocooler models, a compressor skin temperature in the range of 10° C. to 40° C. above the environmental temperature may be mapped to an "operating properly" health level, but a temperature that is over 40° C. above the environmental temperature may be mapped to a "not operating properly" health level.

In certain embodiments, health fingerprint 60 may associate certain parameters with the remaining useful life (RUL) of cryocooler 14. As an example, an input power trend may be derived from measurements over the life of the cryocooler. The measurements may indicate that the available input power level may be exceeded with a certain number of hours with a certain probability. For example, there is a 75% probability that available power will be exceeded within 200 hours.

The definition of RUL may depend on the application. If the cost of failing during operation is higher, a higher probability of continued operation may be required, which may yield a shorter RUL. If the cost of failing during operation is lower, a lower probability of continued operation may be required, which may yield a longer RUL.

In certain embodiments, health monitor 26 may collect parameters from a sample cryocooler 14 in order to generate health fingerprint 60 that may be used for sample cryocooler 14 or other cryocooler 14. In the embodiments, health monitor 26 may collect parameters from sample cryocooler 14 over time. Health monitor 26 may then map the parameters with the health level of cryocooler 14 when the parameters were collected.

System 10 may include components that may be used to collect parameters. As an example, thermal systems may be used to control the temperature of environment 16 of cryocooler 14 in order to obtain parameters under different temperatures. For example, a temperature increasing system (such as a hot enclosure box) and/or a temperature decreasing system (such as an external cooling fan) may be used to heat and/or cool cryocooler 14. As another example, one or more sensors 24 may be used to capture the parameters. System 10 may include a programmable controller that reports parameters to analyzer 42. For example, the controller may report cryocooler input power, voltage, and/or cool-down time.

In certain embodiments, health monitor 26 may detect a failure event and send a notification describing the failure event. In certain embodiments, health monitor 26 may predict that a failure event may occur in the future, and may send a notification describing the failure event and the time at which the failure event is predicted to occur.

A failure event may be an event in which a failure precursor parameter deviates from an expected value or satisfies (such as falls below, meets, or exceeds) a threshold. As an example, a failure event is an event in which the temperature of cryocooler 14 is a certain number of degrees, such as 10° C., above the ambient temperature. As another example, a failure event is an event in which cryocooler 14 has reached a particular remaining useful life, such as a life in the ranges of 500 to 300, or less than 300 hours.

In certain embodiments, health monitor 26 may report cryocooler health in response to a request. As an example, the request may include environmental condition values, and health monitor 26 may provide one or more estimates of cryocooler health at the environmental condition values. Examples of environmental condition values may include the temperature, humidity, vibration level, or barometric pressure of environment 16. In the example, health monitor 26 may estimate the health of cryocooler 14 according to fingerprint 60. For example, fingerprint 60 may indicate the health of cryocooler 14 operating for a particular period of time if environment 16 is at a particular temperature.

As another example, the request may include a future time value, and health monitor 26 may predict cryocooler health at the future time value. As an example, analyzer 42 may use fingerprint 60 to determine the RUL of cryocooler 14 at the current time. Analyzer 42 may then determine the amount of time that cryocooler 14 will be operating between the current time and the future time. Analyzer 42 may then subtract this amount of time from the remaining useful life at the current time to obtain the remaining useful life at the future time.

Sensors 24 and health monitor 26 may determine cryocooler health in any suitable manner. In certain embodiments, health monitor 26 may monitor piston knocking indicators to determine if pistons of cryocooler 14 are knocking, which can be a precursor signal of poor cryocooler health. Examples of piston knocking indicators include sounds and vibrations made by cryocooler 14. Health monitor 26 may determine that piston knocking is occurring if the piston knocking indicators deviate from expected values of sounds and vibrations made by a properly operating cryocooler 14 or satisfy thresholds that indicate piston knocking.

As an example, acoustic sensor 24*a* monitors sounds made by cryocooler 14. Health monitor 26 may detect acoustic changes (such as anomalies) of cryocooler 14, such as piston knocking, which can be a precursor signal of poor cryocooler health. A threshold level for piston knocking severity can be set. Acoustic changes may be recorded along with the environmental/operational parameters at the time of the changes.

As another example, vibration monitor 24*b* may monitor vibration characteristics (such as magnitude and/or frequency) of cryocooler 14. Health monitor 26 may detect changes (such as anomalies) in vibration. Vibration anomalies may indicate piston knocking or increased piston friction. Auxiliary circuitry may be used to filter out background vibration.

In certain embodiments, thermal sensors 24*c* may monitor the temperature at one or more locations of cryocooler 14. For example, thermal sensors 24*c* may include thermalcouplers used to monitor the temperature of different components (for example, the compressor, expander, drive electronics, and/or transfer tube) of cryocooler 14.

Health monitor 26 may then determine if temperature parameters satisfy thresholds. In certain embodiments, one or more temperatures of cryocooler 14 may be used to designate a threshold. For example, a threshold may be reached when one or more temperatures of cryocooler 14 has reached a delta temperature (for example, a temperature in the range of 5° C. to 15° C., such as 10° C.) above an ambient temperature. In certain embodiments, the relationship among the operating temperatures of the different components may be used to designate a threshold. For example, a threshold may be reached when the different between two component temperatures is in the range of 5° C. to 15° C., such as 10° C.

In certain embodiments, waveform monitor 24*d* may obtain waveforms of any suitable waves, such as that of input current and/or voltage. Health monitor 26 may analyze the waveforms to check for waveform distortion that may indicate failure events. In certain embodiments, health monitor 26 may determine normal (or expected) waveforms by accessing information describing the normal waveform or by measuring the waveforms during normal operation. Health monitor 26 may set thresholds that indicate deviations from the normal waveforms.

As an example, health monitor 26 may determine the nominal frequency content of a normal waveform using a frequency content analysis technique, such as a fast Fourier transform (FFT) or discrete Fourier transform (DFT) technique. Health monitor 26 may then check for deviations from the nominal frequency content that may indicate cryocooler wear and/or end of life.

As another example, health monitor 26 may determine that a normal current and/or voltage waveform is sinusoidal. Health monitor 26 may then check for distorted (non-sinusoidal) waveforms that may indicate the presence of a back electromagnetic field (EMF) resulting from degraded motor performance.

As another example, health monitor 26 may determine that a normal current and/or voltage waveform is a square wave. Health monitor 26 may then check for variations from the characteristic harmonics associated with square waves that may indicate a failure event.

As another example, health monitor 26 may determine that the nominal waveform for a sinusoidal voltage drive cryocooler has a very strong frequency content at the drive frequency, and very little power at other frequencies. Health monitor 26 may perform a frequency content analysis to check for frequency components outside of the nominal spectrum envelope that may indicate a failure event.

In certain embodiments, electrical power 24*e* monitors the electrical input of cryocooler 14, for example, power, voltage, and/or current, which may indicate the health of cryocooler 14. For example, a newer cryocooler 14 may require less power to maintain cryocooler 14 at a steady state, but an older cryocooler 14 may require more power.

Figure 3A:
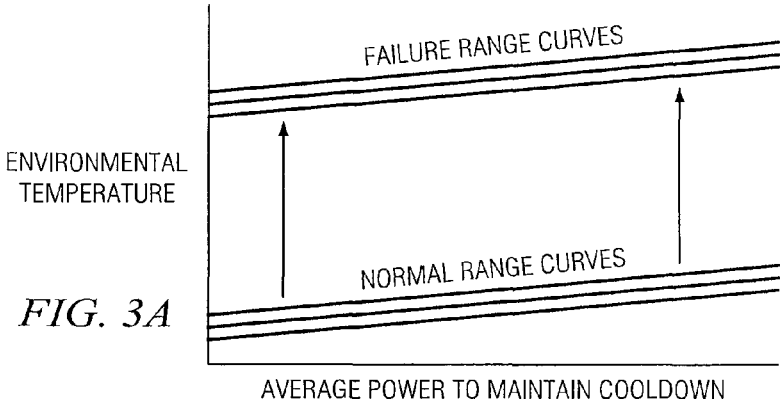
FIGS. 3A through 3C illustrate an example of using electrical input measurements to estimate cryocooler health.
Figure 3B:
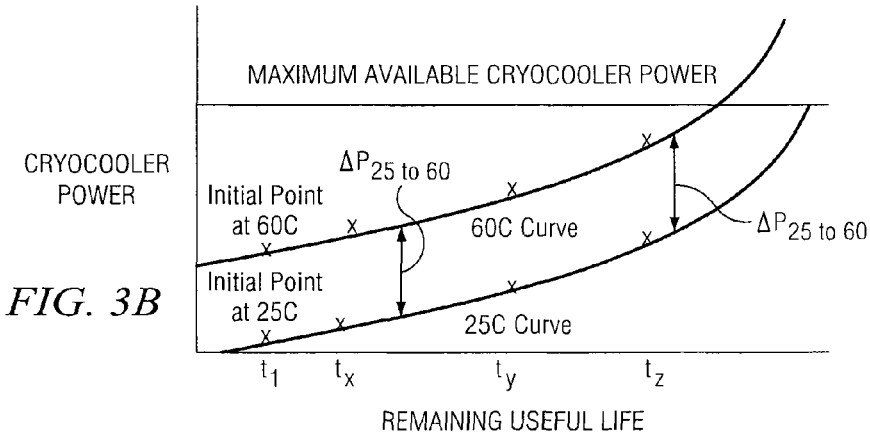
Figure 3C:
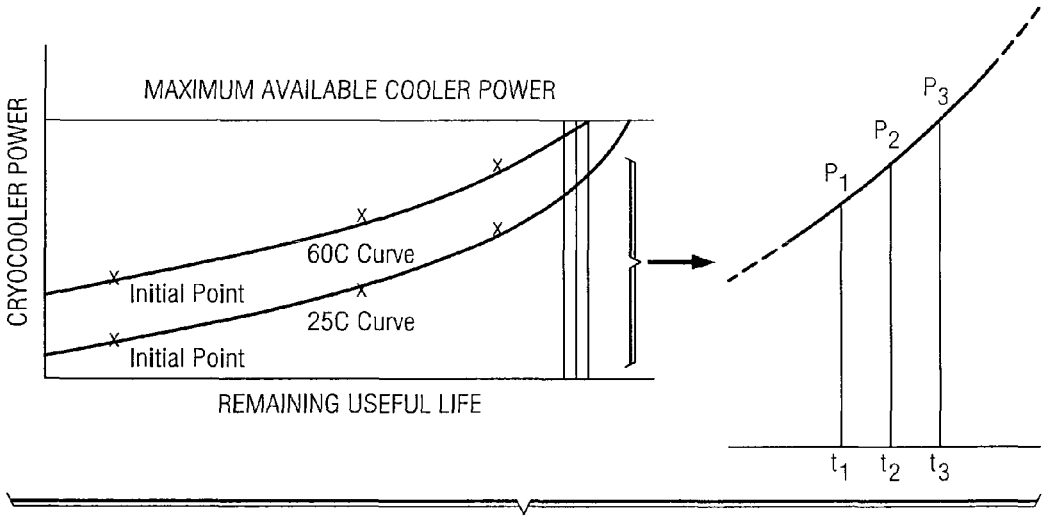

Health monitor 26 may determine cryocooler health from measurements of the electrical input. FIGS. 3A through 3C illustrate an example of using these measurements to determine cryocooler health. In the example, the average power required to maintain steady state of cryocooler 14 at a constant ambient temperature over time is considered. The steady state of cryocooler 14 may be the state at which cryocooler 14 provide constant cooling abilities.

In the example, a thermal survey (FIG. 3A) is performed for one or more sample cryocoolers 14. As cryocoolers 14 degrade, the average power to maintain cooldown increases until the curves reach a failure range, that is, the range at which cooldown can no longer be maintained.

From the thermal survey, initial data points are identified for the average power required to maintain steady state at a constant ambient temperature. The initial points are used to generate curves of the remaining useful life versus cryocooler power at a given environmental temperature (FIG. 3B). (For simplicity, FIG. 3B illustrates only two curves.)

As cryocooler 14 operates, additional points may be recorded and projected onto a constant temperature curve according to the difference in average power that is required to maintain steady state at a given environmental temperature. The power difference may be identified during the initial cryocooler characterization. Over short time increments, a power versus time curve approximates a line (FIG. 3C), and may be regarded as a power versus time line. The slope of the power versus time line increases with operating hours.

The power versus time curves may used to determine cryocooler health in any suitable manner. In certain embodiments, a power versus time line may be extrapolated to determine the time at which the power reaches a maximum available cryocooler power. That time may represent the end of useful life, and the remaining useful life can be calculated from the difference of that time and the current life. The slope of the power versus the time line increases with operating hours, so extrapolation techniques can be used to further increase the accuracy of the remaining useful life estimate.

Figure 4:
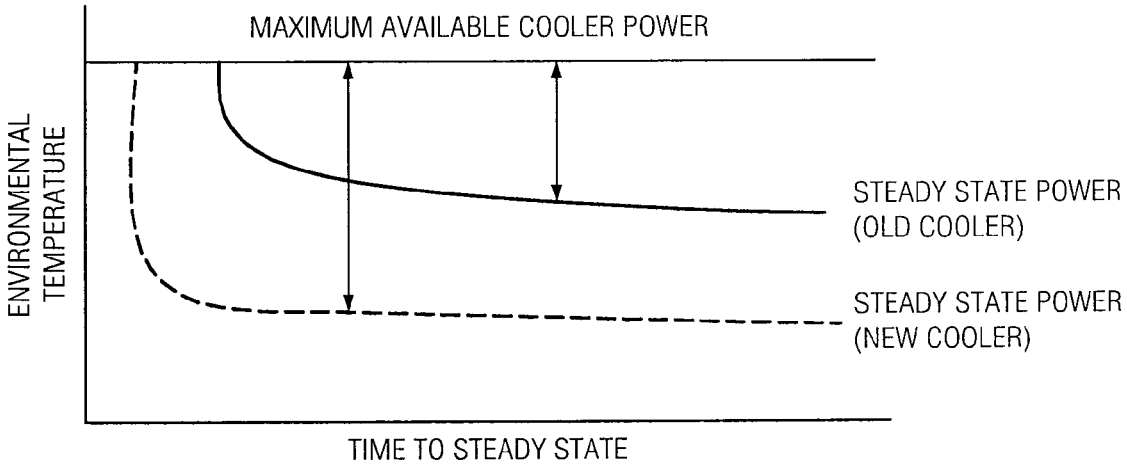
FIG. 4 illustrates an example of using power to estimate cryocooler health.

FIG. 4 illustrates another example of using power to determine cryocooler health. In the example, the power headroom of a steady state of the cryocooler is considered. The power headroom is the difference between the power required by the cryocooler while cooling from an environmental temperature to a target temperature (typically about 77 degree Kelvin) and the available drive power.

The power headroom at steady state from the maximum available power decreases as cryocooler 14 wears. Health monitor 26 tracks the rate of decrease at a given temperature and projects the rate to different environments. Health monitor 26 calculates the remaining useful life from the degradation rate.

Returning to FIG. 2, health monitor 26 may determine cryocooler health from measurements of the electrical input in other suitable manners. For example, a cooldown profile may be used. Cooldown curve characteristics, such as cooldown curve shape, cooldown time, focal plane array (FPA) temperature versus time, or input power versus time, may be measured. As an example, the standard deviation of the steady state power required to maintain constant FPA temperature while in a constant environmental temperature may increase as failure approaches. Accordingly, health monitor 26 may track the rate of change of the standard deviation to detect a failure event.

Figure 5:
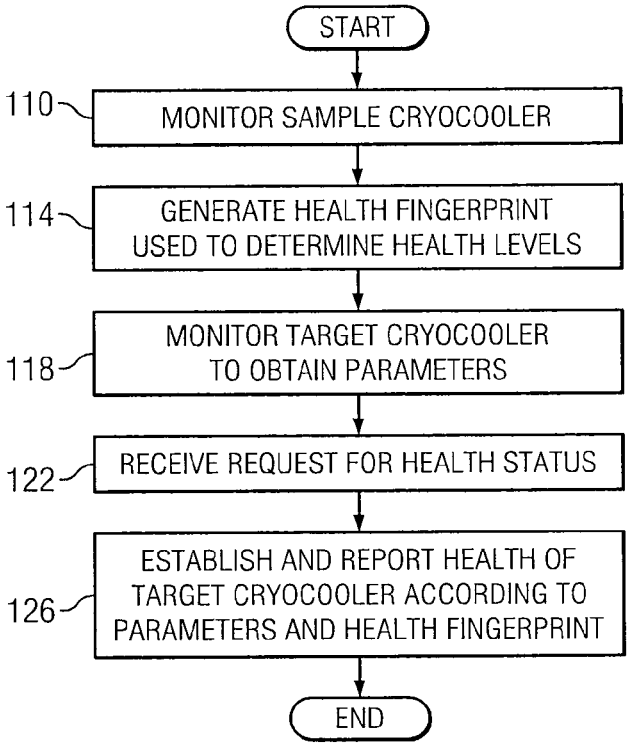
FIG. 5 illustrates an example of a method of monitoring cryocooler that may be used by the system of FIG. 1.

FIG. 5 illustrates an example of a method of monitoring cryocooler 14 that may be used by system 10. The method starts at step 110, where system 10 monitors a sample cryocooler 14. In certain embodiments, sensors 24 may monitor sample cryocooler 14 to obtain failure precursor parameters to generate health fingerprint 60. Health monitor 26 may generate a health fingerprint 60 from the parameters at step 114. Health fingerprint 60 may associate health cursor parameters with particular health levels of sample cryocooler 14.

System 10 may monitor a target cryocooler to obtain failure precursor parameters that indicate the health of target cryocooler at step 118. For example, the data may be filtered for long term trending, and the RUL may be estimated form the trends. A request for the health status of target cryocooler 14 may be received at step 122. The health of target cryocooler 14 may be established at step 26 according to the parameters of target cryocooler 14 and health fingerprint 60. Analyzer 42 may establish the health by identifying the health status associated with the parameters according to the health fingerprint 60. The method then ends.

Figure 6:
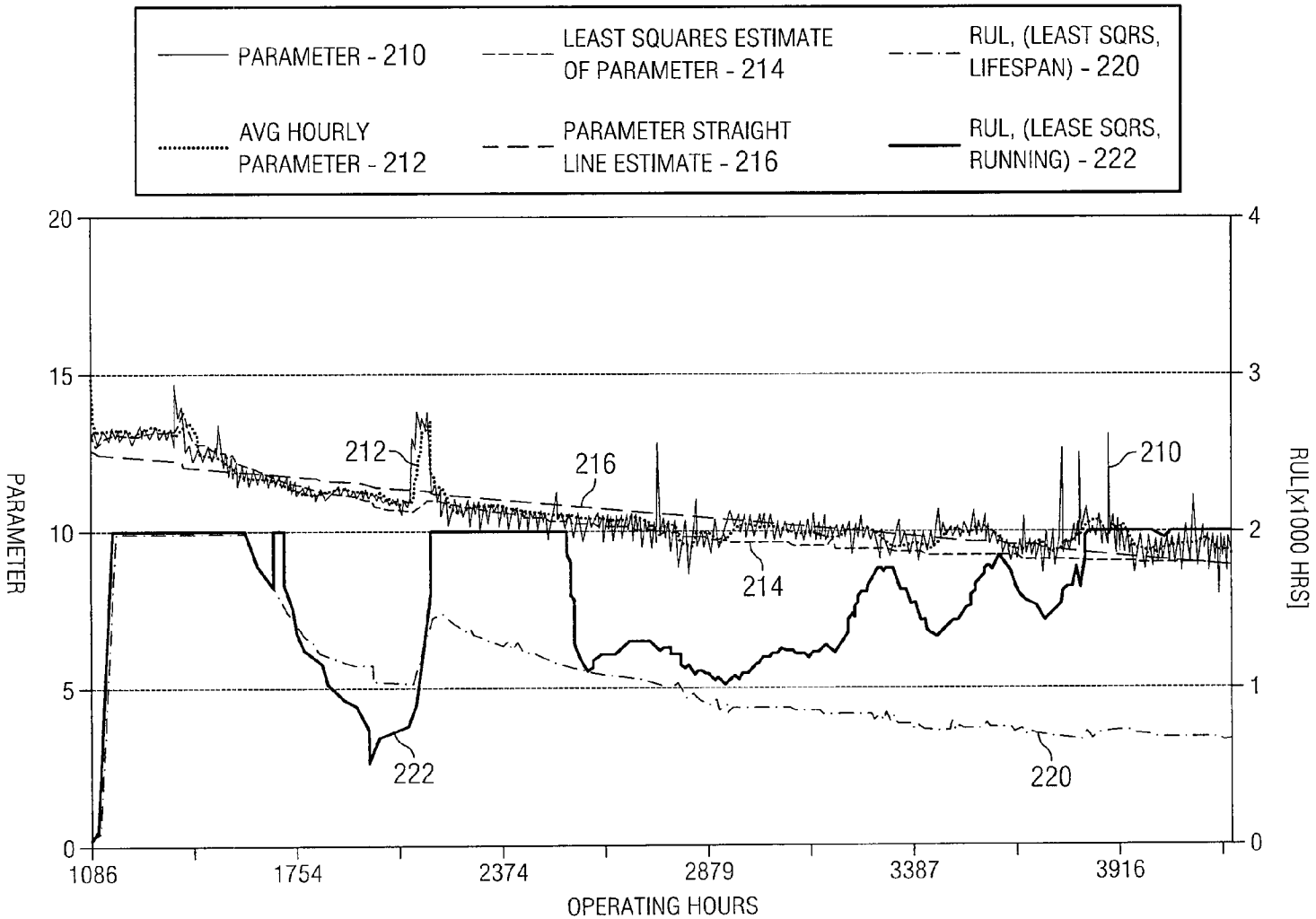
FIG. 6 illustrates an example of a method for estimating remaining useful life that may be used by the system of FIG. 1.

FIG. 6 illustrates an example of a method for estimating remaining useful life that may be used by the system of FIG. 1. Information may be collected and used to generate a health fingerprint 60 for sample cryocooler 14 and other cryocoolers 14 similar to sample cryocooler 14. In the example, parameter curve 210 represents raw data from sampling any suitable property of sample cryocooler 14. An example of a parameter is efficiency. Efficiency may be measured using any suitable property, such as the input power level divided by the difference between the environmental temperature and the focal plane array target temperature.

Certain curves track parameter curve 210 with filtering and projection methods, which may be used to smooth parameter curve 210. Average hourly parameter curve 212 represents the hourly average of the parameter, and the least squares estimate of parameter curve 212 represents the least squares estimate of the parameter. Parameter straight line 216 represents a linear fit to the data starting from the earliest data through to the current data. Parameter straight line 216 tracks new data slowly, and may be a good running estimate of the data trends.

Certain curves provide examples of remaining useful life (RUL) estimates. RUL curves 220 and 222 use the least squares fit of the average hourly parameter data to a straight line. The line may be projected to the future. Failure may be predicted when the parameter reaches a threshold indicating system failure.

RUL curve 222 is based on smoothing the parameter data over the past 600 hours of operation. RUL curve 222 is noisy and even trends upward for long periods. RUL curve 220 is based on the data trend since the start of life. RUL curve 220 starts out noisy, but then settles down to a consistent trend line.

RUL curves 220 and 222 may be used to determine the remaining useful life of a target cryocooler 14 from the parameter measurements of target cryocooler 14. For example, an efficiency of less than 5% may indicate that the remaining useful life is less than 1000 hours.

Modifications, additions, or omissions may be made to the systems and apparatuses disclosed herein without departing from the scope of the invention. The components of the systems and apparatuses may be integrated or separated. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods disclosed herein without departing from the scope of the invention. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure, as defined by the following claims.

What is claimed is:

1. A method comprising:

monitoring a plurality of physical properties of a cryocooler to obtain one or more failure precursor parameters, the one or more failure precursor parameters indicating a health of the cryocooler, wherein monitoring the plurality of physical properties comprises monitoring available power headroom and slopes of a power versus time curve at different environmental temperatures wherein, power is an average power used to maintain the cryocooler at steady state over time at a given environmental temperature, and power headroom is the difference between the average power required at steady state at a given environmental temperature and available maximum power;

accessing a health fingerprint of the cryocooler, the health fingerprint generated from collected parameters of a sample cryocooler similar to the cryocooler, and the health fingerprint associating the one or more failure precursor parameters with a health level of the cryocooler; and estimating the health of the cryocooler in accordance with the health level.

2. The method of claim 1, further comprising:

determining that a failure precursor parameter has satisfied a threshold; and sending a notification in response to the determination.

3. The method of claim 1, wherein estimating the health of the cryocooler further comprises:

determining a time at which the power reaches a maximum available cryocooler power, the time representing an end of useful life; and estimating a remaining useful life according to the end of useful life.

4. The method of claim 1, wherein monitoring the plurality of physical properties further comprises: monitoring a power headroom of a steady state of the cryocooler; and wherein estimating the health of the cryocooler further comprises:

calculating a rate of decrease of the power headroom; and determining a particular remaining useful life that corresponds to the rate of decrease.

5. The method of claim 1, wherein monitoring the plurality of physical properties further comprises: monitoring one or more piston knocking indicators to monitor piston knocking of the cryocooler, the one or more piston knocking indicators comprising sounds or vibrations made by the cryocooler; and wherein estimating the health of the cryocooler further comprises: determining that the one or more piston knocking indicators have deviated from one or more expected values.

6. The method of claim 1, wherein monitoring the plurality of physical properties further comprises monitoring temperature at one or more locations of the cryocooler; and estimating the health of the cryocooler further comprises determining that the temperature has satisfied a threshold.

7. The method of claim 1, wherein monitoring the plurality of physical properties further comprises monitoring a waveform of input current or voltage; and wherein estimating the health of the cryocooler further comprises determining that the waveform deviates from an expected waveform.

8. The method of claim 1, wherein estimating the health of the cryocooler further comprises:

receiving one or more environmental condition values; and estimating the health of the cryocooler at the one or more environmental condition values.

9. The method of claim 1, wherein estimating the health of the cryocooler further comprises:

receiving a future time value; and predicting the health of the cryocooler at the future time value.

10. The method of claim 1, further comprising:

predicting a future time when a failure event may occur; and sending a predicted failure notification in response to the prediction.

11. The method of claim 1, further comprising generating the health fingerprint from collected parameters of a sample cryocooler similar to the cryocooler by:

monitoring a plurality of physical properties of the sample cryocooler to obtain one or more failure precursor parameters, the one or more failure precursor parameters indicating a health of the sample cryocooler; and associating the one or more failure precursor parameters from the sample cryocooler with a health level of the sample cryocooler and any other cryocooler similar to the sample cryocooler.

12. An apparatus comprising:

a computer readable medium configured to store logic, the logic when executed by a processor configured to:

monitor a plurality of physical properties of a cryocooler to obtain one or more failure precursor parameters, the failure precursor parameter indicating health of the cryocooler, wherein monitoring the plurality of physical properties comprises monitoring available power headroom and slopes of a power versus time curve at different environmental temperatures wherein, power is an average power used to maintain the cryocooler at steady state over time at a given environmental temperature, and power headroom is the difference between the average power required at steady state at a given environmental temperature and available maximum power;

access a health fingerprint of the cryocooler, the health fingerprint generated from collected parameters of a sample cryocooler similar to the cryocooler, and the health fingerprint associating the one or more failure precursor parameters with a health level of the cryocooler; and estimate the health of the cryocooler in accordance with the health level.

13. The apparatus of claim 12, wherein the logic, when executed by the processor is further configured to:

determine that the failure precursor parameter has satisfied a threshold; and send a notification in response to the determination.

14. The apparatus of claim 12, wherein the logic, when executed by the processor is further configured to:

estimate the health of the cryocooler by determining a time at which the power reaches a maximum available cryocooler power, the time representing an end of useful life; and estimating a remaining useful life according to the end of useful life.

15. The apparatus of claim 12, wherein the logic, when executed by the processor is further configured to:

monitor the plurality of physical properties by monitoring a power headroom of a steady state of the cryocooler; and estimate the health of the cryocooler by: calculating a rate of decrease of the power headroom; and determining a particular remaining useful life that corresponds to the rate of decrease.

16. The apparatus of claim 12, wherein the logic, when executed by the processor is further configured to:

monitor the plurality of physical properties by monitoring one or more piston knocking indicators to monitor piston knocking of the cryocooler, the one or more piston knocking indicators comprising sounds or vibrations made by the cryocooler; and estimate the health of the cryocooler by determining that the one or more piston knocking indicators have deviated from one or more expected values.

17. The apparatus of claim 12, wherein the logic, when executed by the processor is further configured to:

monitor the plurality of physical properties by monitoring temperature at one or more locations of the cryocooler; and estimate the health of the cryocooler by determining that the temperature has satisfied a threshold.

18. The apparatus of claim 12, wherein the logic, when executed by the processor is further configured to:

monitor the plurality of physical properties by monitoring a waveform of input current or voltage; and estimate the health of the cryocooler by determining that the waveform deviates from an expected waveform.

19. The apparatus of claim 12, wherein the logic, when executed by the processor is further configured to estimate the health of the cryocooler by:

receiving one or more environmental condition values; and estimating the health of the cryocooler at the one or more environmental condition values.

20. The apparatus of claim 12, wherein the logic, when executed by the processor is further configured to estimate the health of the cryocooler by:

receiving a future time value; and predicting the health of the cryocooler at the future time value.

21. The apparatus of claim 12, wherein the logic, when executed by the processor is further configured to:

predict a future time when a failure event may occur; and send a predicted failure notification in response to the prediction.

22. The apparatus of claim 12, the logic, when executed by the processor is further configured to generate the health fingerprint from collected parameters of a sample cryocooler similar to the cryocooler by:

monitoring a plurality of physical properties of the sample cryocooler to obtain one or more failure precursor parameters, the one or more failure precursor parameters indicating a health of the sample cryocooler; and associating the one or more failure precursor parameters from the sample cryocooler with a health level of the sample cryocooler and any other cryocooler similar to the sample cryocooler.

23. An apparatus comprising:

a computer readable medium configured to store logic such that when executed by a processor is configured to:

monitor a plurality of physical properties of a cryocooler to obtain one or more failure precursor parameters, the one or more failure precursor parameters indicating health of the cryocooler, the one or more failure precursor parameters including at least one of an actual measured value or a value derived from the measured value, wherein monitoring the plurality of physical properties comprises monitoring available power headroom and slopes of power versus time curve at different environmental temperatures wherein, power is an average power used to maintain the cryocooler at steady state over time at a given environmental temperature and power headroom is the difference between the average power required at steady state at a given environmental temperature and available maximum power;

when the cryocooler is a sample cryocooler, generate a health fingerprint of the sample cryocooler and any other cryocooler similar to the sample cryocooler from the one or more failure precursor parameters of the sample cryocooler, wherein the health fingerprint associates one or more failure precursor parameters from the sample cryocooler with a health level of the sample cryocooler and any other cryocooler similar to the sample cryocooler;

when the cryocooler is not a sample cryocooler, access the health fingerprint of the cryocooler, the health fingerprint generated from collected parameters of a sample cryocooler similar to the cryocooler, the health fingerprint associating the one or more failure precursor parameters from the cryocooler with a health level of the cryocooler;

estimate the health of the other cryocooler in accordance with the health level;

determine that a failure precursor parameter of the one or more other failure precursor parameters has satisfied a threshold; and send a notification in response to the determination.

24. The apparatus of claim 23, wherein the logic, when executed by the processor is further configured to:

estimate the health of the other cryocooler by:

determining a time at which the power reaches a maximum available cryocooler power, the time representing an end of useful life; and estimating a remaining useful life according to the end of useful life.

25. The apparatus of claim 23, wherein the logic, when executed by the processor is further configured to:

monitor the plurality of physical properties by: monitoring a power headroom of a steady state of the cryocooler; and estimate the health of the other cryocooler by calculating a rate of decrease of the power headroom; and determining a particular remaining useful life that corresponds to the rate of decrease.

26. The apparatus of claim 23, wherein the logic, when executed by the processor is further configured to:

monitor the plurality of physical properties by monitoring one or more piston knocking indicators to monitor piston knocking of the cryocooler, the one or more piston knocking indicators comprising sounds or vibrations made by the cryocooler; and estimate the health of the other cryocooler by determining that the one or more piston knocking indicators have deviated from one or more expected values.

27. The apparatus of claim 23, wherein the logic, when executed by the processor is further configured to:

monitor the plurality of physical properties by monitoring temperature at one or more locations of the cryocooler; and estimate the health of the other cryocooler by determining that the temperature has satisfied a threshold.

28. The apparatus of claim 23, wherein the logic, when executed by the processor is further configured to:

monitor the plurality of physical properties by monitoring a waveform of input current or voltage; and estimate the health of the other cryocooler by determining that the waveform deviates from an expected waveform.

* * * * *

UNITED STATES PATENT AND TRADEMARK OFFICE

CERTIFICATE OF CORRECTION

PATENT NO. : 8,794,016 B2
APPLICATION NO. : 12/540576
DATED : August 5, 2014
INVENTOR(S) : Ogden et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1275 days.

Signed and Sealed this
Eighth Day of September, 2015

Michelle K. Lee

Michelle K. Lee
*Director of the United States Patent and Trademark Office*